United States Patent [19]

Quante

[11] Patent Number: 4,934,097

[45] Date of Patent: Jun. 19, 1990

[54] BARRIER POST FREE OF JAMMING POINTS

[75] Inventor: Heinrich Quante, Recklinghausen, Fed. Rep. of Germany

[73] Assignee: Armo Gesellschaft Fur Baulemente, Bau-Und Wohnbedarf GmbH, Recklinghausen, Fed. Rep. of Germany

[21] Appl. No.: 294,565

[22] PCT Filed: Oct. 2, 1987

[86] PCT No.: PCT/DE87/00448

§ 371 Date: Dec. 19, 1988

§ 102(e) Date: Dec. 19, 1988

[87] PCT Pub. No.: WO88/08056

PCT Pub. Date: Oct. 20, 1988

[30] Foreign Application Priority Data

Apr. 9, 1987 [DE] Fed. Rep. of Germany ... 3712019[U]
Apr. 9, 1987 [DE] Fed. Rep. of Germany ... 8705304[U]

[51] Int. Cl.[5] ..... E01F 13/00

[52] U.S. Cl. ..... 49/49; 404/6; 74/89.15

[58] Field of Search ..... 49/9, 49, 131; 404/6; 74/89.15

[56] References Cited

U.S. PATENT DOCUMENTS 3,017,146 1/1962 Wagner .
3,061,960 11/1962 Dull .
3,118,352 1/1964 Ray et al. .
3,141,639 7/1964 Klein .
3,202,414 8/1965 Simmons et al. .
3,963,363 6/1976 Roper .
4,333,268 6/1982 Dumbeck .

FOREIGN PATENT DOCUMENTS 0095032 of 0000 Fed. Rep. of Germany .
564652 of 0000 Fed. Rep. of Germany .
1580047 of 0000 Fed. Rep. of Germany .
3141701 of 0000 Fed. Rep. of Germany .
3303451 of 0000 Fed. Rep. of Germany .
7437898 of 0000 Fed. Rep. of Germany .
8603531 of 0000 Fed. Rep. of Germany .
2819625 11/1979 Fed. Rep. of Germany ..... 49/49
8705304 7/1987 Fed. Rep. of Germany .
1246051 of 0000 France .
1469470 of 0000 France .
2312634 of 0000 France .

*Primary Examiner*—Joseph Falk
*Assistant Examiner*—Gerald A. Anderson
*Attorney, Agent, or Firm*—Herbert Dubno

[57] ABSTRACT

A barrier post (1) for closing a variety of access paths as well as parking lots and parking spaces in particularly easy to use and entails no risk to the user, for example by the presence of clamping points, because the swivel hinge (4) is divided into a lower and an upper hinge (6, 7). The lower hinge (6) constitutes the link between the base (13) and the displacement shaft (11) and then only after that with the tube (5) whereas the upper hinge (7) is the link between base (3) and tube (5). The displacement shaft (11) is connected, either directly through its movement nut (15) or indirectly through a guide (8), a sliding guide (9) and movement unit (15), with the tube (5) and raises or lowers the tube by appropriate rotation. This is achieved by means of a motor (13) with drive (12) accommodated in the tube (5), but which the movement nut (15) together with the whole tube (15) is pivoted upwards or downwards, depending on the direction of rotation. By fixing a spring (22) to the movement nut (15), the vertical forces are absorbed, which makes simultaneous reduction of the driving forces possible. Unintentional raising of the barrier post (1) when a vehicle (60) is parked above it is effectively prevented because the receiver (57) is blocks by the parked vehicle. The receiver (57) is reactivated, the motor switched on and the barrier past (1) pivoted upwards only when the vehicle has left its parking place.

20 Claims, 8 Drawing Sheets

BARRIER POST FREE OF JAMMING POINTS

CROSS REFERENCE TO RELATED APPLICATION

This application is a National Phase Application of PCT/DE 87/00448 filed 2 Oct. 1987 and based, in turn, upon German applications P37 12 019.0 and G87 05 304.7 filed 9 Apr. 1987 under the International Convention.

FIELD OF THE INVENTION

My present invention relates to a barrier post for access ways, parking lots and parking spaces with a base which is anchored in the ground and with a tube which is swingable about a swivel hinge from the horizontal into the vertical position and vice versa, with a motor and a drive lodged in the tube and optionally with a receiver or control element, also located in the tube and activatable via a portable transmitter.

BACKGROUND OF THE INVENTION

In order to close parking lots, driveways and access roads, it is known to use barriers or gates equipped with corresponding actuating means which can be remote-controlled. Such barriers usually have a rigid cast-iron base which on its upper part, has the shape of some kind of a spherical head and a correspondingly built barrier which can swing thereabout by approximately 90°. Such a barrier or blocking device is known from German Patent 19 60 399.0.

A blocking device, which is basically the same, is known from German Patent 27 12 546.8, but in this case the stable, cast-iron post has been eliminated. In this case also, the barrier per se is swingable around an articulation located at the top of the post, whereby a locking device ensures that it can also be actuated manually, in a simple manner.

Also known are the round or square section simple posts, blocking driveways or accesses, which are foldable and which allow access to the driveway or the entrance way be being folded down. The folding of the posts is done manually in this case and, for this purpose, the driver has to leave the vehicle. This is bothersome and disadvantageous, praticularly in bad weather.

Finally, such a vehicle trying to park frequently creates an inconvenient traffic hindrance. Besides, it is also necessary to equip the barrier post with a lock, in order to prevent the folding down of the post by unauthorized persons, for passage.

Also, finally a barrier post is known (German open application 35 14 626.5) which is swingable about a horizontal hinge, located at ground level. The motor and drive required for the swinging motion are located in the swingable part of the post, i.e. the tube. This presents considerable maintenance advantages and which particularly facilitates the use of such barrier posts in car ports, since the overall height of the post of its bases can be considerably limited and preliminary work in or on the ground of the car port is not required. The motor can be provided with a control element, which is remote-controlled, so that the driver can fold the post down or up from the vehicle.

In the case of this known barrier post, there is the disadvantage that, in the area of the articulation, jamming points exist, which especially in the case of careless handling, but also during assembly and disassembly, can become danger points. It is also disadvantageous that for the raising or lowering, but particularly for the raising of the post, considerable force has to be applied, whereby in the known device a cable is used, which in addition also has to be guided. The mechanic effort is thus relatively high.

OBJECT OF THE INVENTION

It is the object of the invention to provide a barrier post free of jamming points, operatable with little effort and in a safe manner.

SUMMARY OF THE INVENTION

The problem is solved according to the invention, by subdividing the swivel hinge into an upper and a lower hinge, offset with respect to each other, which on the one hand connects the tube with the base, and on the other hand, connects a motion screw arranged in the tube and whose one end is swingably connected to the base and the other end is guided along the tube, whereby the guiding is perfomed by a motion nut, movable along the motion screw which is rotatable by means of a motor and vertically arranged in the tube.

In a barrier post of this kind, no jamming points exist, since each of the individual components can slide into the other or over each other in such a manner, that the danger of injury is exluded. Such a barrier post is advantageously safe and can be operated with little energy consumption, since the rotatable motion screw and the motion nut displaceable thereon constitute a simple drive system. The screw is set in motion (e.g. rotation) by the motor via the drive whereby, depending on the rotation direction of the motion screw, the motion nut moves upwardly or downwardly along the screw so that the tube is raised or lowered. The motion nut can either be fastened, so that the motion screw moves therein up, down, or vice versa, depending on the direction in which the sliding guide with the motor is mounted in the tube. Based on the relatively reduced forces to be applied, all the components can be located in the tube, without any further ado, so that they are well protected and easily accessible. To the drive or motor, a receiver or emitter and control element are assigned, through which the remote-control cna be performed in a simple manner.

According to a particularly suitable embodiment of the invention, the motion screw is linked to the lower hinge connected to the base via a rocker-arm- or pistol-handle-like end portion, and the motion nut is fastened at a distance therefrom, in the head area of the tube. The motion screw with the motor is suitably inserted in this end portion, which also forms a kind of additional housing, so that the motion of the motor can simply and safely be transmitted to the end portion. This end portion is mounted on the lower hinge, so that when the motion nut is fastened in position, the swingable portion of the barrier post is automatically set in motion.

A second suitable embodiment provides for the upper hinge to be developed and mounted at the inner flexion point of the tube, and for the lower hing to be mounted at the outer flexion point of the tube. According to the invention, it is necessary that both hinges be arranged offset with respect to each other the here-described embodiment simplifies the arrangement of the motion screw or its rocker-arm-like end portion, which, as already mentioned, is linked to the lower hinge, mounted at the lower flexion point of the tube.

The motion screw or the motor with the end portion has to follow a corresponding swivel path, when the post is either raised or lowered. In order to make this possible and at the same time to facilitate a safe support of the components, the motor and its motion screw can be supported so as to be transversely displaceable in a holder with a slot assigned to the inside wall of the tube, between the lower hinge and the motion nut. The corresponding components can thus perform the necessary motion, whereby they are securely guided and supported.

The jamming points, especially on the moving areas of the parts, can be advantageously avoided when the end portion is shaped according to the invention, like a pistol handle, whereby the lower hinge is arranged at the outer end of the handle and the tube wall reaches to the inner handle end. The lower portion or the bottom edge of the handle forms at an same time the extension of the tube wall, e.g. an external walling, when the post is in upright position. During the swivel motion, however, the handle protrudes somewhat from the line of the tube wall, but this does not create any problems, since the tube wall reaches closely to the handle end, which is correspondingly curved.

In order to be able to safely secure the post in place, and, on the other hand, to be able to remove it in a case of embergency, e.g. to accommodate firefighters, the tube is provided with a tongue, reaching into the area of the base and between the two hinges, having a hold which is shaped correspondingly to the cylinder of a lock. A cylinder lock is thereby secured in the outer wall or the base, so that by removing or opening the lock, the tongue is released, whereby due to the following swinging motion, a downpressing of the post or the tube becomes possible, even against the force of the corotationally moving screw.

According to a further embodiment, the motion screw is secured in the upper portion of the tube and the motion nut is articulatedly linked to a first guide, over a sliding second guide displaceable on the tube, which first guide in turn is slidably mounted and at the end of the based articulatedly is linked to the upper hinge. Such a construction makes possible the indirect raising and lowering of the tube, through the motion of the sliding guide or the guide tube. This ensures a jam-free motion of the tube, but in this case more external components are required, which due to the weather, need special safegauarding and also will require meaintenance.

By contrast, in the next described embodiment the connection between tube and base is such that an intermediate maintenance is not necessary, since the corresponding points are weatherproof. The base and the tubes have correspondingly running inclines, starting from the lower hinge, whereby the guide and the base, starting from the upper hinge, have a vertically running partition. This configuration of the inclines on the one hand, and of the partition, on the other hand, insures for each a sufficient overlapping, whereby the base has a rear wall covering or projecting over the incline, so that no gaps remain, which could act as jamming points or create weather problems In order to insure a safe guiding on the tube, it is advantageous to form the sliding guide as a hollow tube surrounding the tube and connected to the guide via an articulation and to the motion nut via releasable pins. Via this separate articulation, the sliding guide can be moved back and forth on the tube without jamming, so that unobjectionable transmission of forces from the motion nut via the pins to the sliding guide and the remaining parts of the guide is insured. Since the pins are releasable, it is also possible to remove them and then to fold the post down manually, which can be necessary especially in cases when access has to be given to firefighters or police. For this reason, the invention also provides for the pins to be threaded and to be secured in the motion nut by this threading and to be releasable via a thihedron. Such trihedrons are commonly used by the fire department and the police, so that they can always pass such access ways with their keys. Where an access for such officials does not have to be provided, for instance in regular parking places or parking garages, it is not necessary to have these releasable pins.

An additional guiding is provided by the pins guided in slots which are formed in the tube, whereby the slots run parallel to the tube edges. In such an embodiment, the slots can be adjusted to fit the shape of the pins, whereby an additional sealing can be provided for the slots by, for instance, overlapping rubber strips. Another possibility is to create the guide and the sliding guide as a unit and to guide the pins in the slots formed in the tube, these slots having a curved shape. In such an embodiment, a single-part guide/sliding guide unit operates, which however has the disadvantage that the slots have to curved, each corresponding to the length of the guide and the sliding guide, because otherwise this construction can lead to a jamming between the parts. A further safeguard against jamming points is created when the contact edges between the base, tube, guide and sliding guide are deburred and bevelled towards the inner space. Then there is no surface left, where jamming could occur or where a finger could be caught.

The force required for raising and lowering the tube with respect to the base is safely transmitted in that the guide, which is connected to each the base and the sliding guide by an articulation, is built as a force-transmitting sliding hood. The sliding guide itself consists of a force-transmitting hollow tube, so that altogether the transmission of the forces originating from the motion nut is insured.

In order to absorb or compensate as much as possible the torque produced at the start of the motor, in another feature of the invention, it is provided that the motion screw be supported by a bearing above the upper and lower hinge, and that between bearing and motion nut a spring serving as a torque stay rod be provided. This spring is compressed by the motion nut during the lowering of the tube, whereby the forces required therefore are produced partially due to the fact that the tube folds down as a result of its own weight. When the tube is raised, the spring force action is such that it pushes additionally the motion nut on the motion screw in a forward direction or so pushes the motor with the drive. Thereby, the spring suitably presents a characteristic curve or a spring force, which insures an approximate compensation of the upward forces. The penetration of humidity into the mutually displacing parts is prevented simply by suitably provided gaskets.

An unintended raising of the barrier post lying underneath a parked vehicle is prevented by a construction of the barrier post, wherein above the motion nut or the motion screw, in the head of the tube the receiver assigned to the motor is mounted. This receiver can be blocked, preferably forcibly blocked by a correspondent in the vehicle which is parked in the locked parking space assigned to the tube. This construction is assembly-friendly because the parts requiring maintenance, including the receiver and the locking device are located in the barrier post itself, i.e. in the tube. Furthermore, such a barrier post is absolutely safe operationally, since it requires only a reduced height above the ground level, so that a damaging of the vehicle by the folded down post is precluded. Since in addition thereto, the receiver assigned to the drive can be blocked with respect to the remote control, and is blockable particularly then when the post is folded down for passage by the vehicle, it is certain that even when the emitter of the remote control is inadvertently activated, the post will be raised.

Hence damage to the bottom of the vehicle, whether intentional or not, is absolutely prevented. Such a barrier post satisfies thereby all the pertinent traffic regulations and saves the trouble for the vehicle owner to inspect the bottom of the vehicle for damage each time vehicle passes over the post.

A particularly advantageous safeguard against raising of the post utilizes a Doppler-effect microwave transmitter - and receiver assigned to the head of the tube or the transmitter, since when the Doppler effect occurs, the receiver is blocked. Thereby, the emitter is suitably turned off, when the vehicle standing over the post produces a Doppler-effect. But when the vehicle is not standing over the folded post, the Doppler-effect cannot occur, and the receiver remains fine-tuned, so that the post can be raised at any time as desired, for instance when the vehicle has left the parking space and the space is to be protected against unauthorized use. In order to improve this feature, it is provided that the microwave emitter and receiver are switchable by a sensor which can be activated by an impact on the driveway, and in this way. It can prevent a response to a kind of Doppler-effect due to the vehicle coming too close to the still standing post a kind of Doppler-effect occurs which would lead to the impossibility of lowering the standing post through remote control. The sensor thus fine-tunes the raising safety.

A further possibility to block the receiver is according to the invention to mount a pressure switch in one of the thread paths of the driveway, whereby the pressure switch is connected to block the receiver. When the vehicle passes over the pressure switch or stops on the pressure switch the receiver can be effectively blocked as long as necessary. When the vehicle leaves the pressure switch, after a correspondingly selected delay, the receiver is again activatable, the post can then safely be raised again after the vehicle has left the parking space.

For the temporary blocking of the receiver it is also possible to subordinate the receiver to an emitter set to block in response to a label system, whereby the label corresponding to the receiver is mounted on the vehicle with an integrated metal strip. By the term safety labels one understands safety label I mean tags or labels, such as for instance used in the retail business for the prevention of shoplifting. The labels are here fastened under the bumper, namely suitably under the rear bumper and are recognized by the receiver mounted in the post. Thus the actual receiver of the remote control is blocked, so that an inadvertent raising of the post is safely precluded, as long as the vehicle stands above it. A metal strip made of a special alloy with a particular hysteresis curve is worked into the labels, which when put in a magnetic field can be modified on the receiving side in such a manner that they can be used for a corresponding signals.

In a further construction, the receiver can be disabled in a controlled manner by the vehicle, in that it can be blocked with the aid of an induction loop located in the driveway and a thereto assigned control device. The vehicle disturbs the induction loop and thereby blocks the receiver. Further, injuries through jamming or the like are avoided due to the fact that the drive is built to deliver only 150N or less.

A further safeguard can be achieved according to the invention, by providing, in addition to the upper and lower hinge, an articulation arranged vertically with respect to the longitudinal axis of the tube and that in addition to the drive, tube. In addition a swivel drive is provided. In this type of construction, the barrier post is first folded down from the vertical into the horizontal position, in order to be then swung about in the horizontal position, so that it becomes possible, after the passage of the vehicle, to swing it back and then to raise it again, so that the vehicle can not be removed by an unauthorized person without destroying the barrier post. In this way double security is afforded.

In order to insure the activation of a barrier post swingable about a double articulation and to avoid false information, the horizontally lying hinge is supported in the travel direction of the vehicle and the motor and the swivel drive are connected to be alternately actuatable. Such a construction insures that when a parking space closed off by a barrier post is approached first the drive is activated, in order to bring the post from the vertical to the horizontal position. Only when this drive is disconnected, can the swivel drive be activated. The first drive can switch on the swivel drive automatically. Thus the barrier post is folded down at first into the travel direction can be swung in the direction of travel. In position it can be passed easily by the vehicle. After the vehicle has assumed its parking position, the swivel drive is activated first activated, respectively so that the horizontally lying barrier post is brought from the direction-of-travel position into the transverse position, before the drive is activated to bring the post, respectively the tube to its vertical position. In this vertical position, the barrier post closes the parking space or the access, so that now even an unauthorized activation of the barrier post cannot do any damage. Furthermore, the barrier post is always brought back to the locking position, with corresponding switching, so that damage to the bottom of the vehicle cannot occur.

Vandalism or inadvertent damage can be easily recognized when the post is provided with an acoustic or optical signal emitter, which is connected to sensors arranged on the base, laterally with respect to the tube and to the motor. The sensors detect each movement of the post and are connected so that when the drive is stationery, they immediately switch on the signal emitter, i.e. announcing danger. Also other activation- and blocking impulses or emitters can be used, such as radar, infrared, laser, ultrasound devices. Suitably, in order to conserve the batteries or the electric current assigned to the drive, the current required for the drive is only then supplied when an activation of the system takes place. Otherwise, only a quiescent current as close as possible to zero is activated, whereby it is conceivable with the proper devices to supply this quiescent current intermittently, in order to prolong the life of the required batteries. For instance it is conceivable to supply quiescent current in 5-seconds pulses, which however requires that the emitter be in operation for a correspondingly long time when activated. Further energy sources can be found in solar cells and the like. Whereby the solar cells can be used also for switching on the system, for instance with the car headlights.

The invention distinguishes itself particularly by the fact that it creates a barrier post which, due to its construction, is absolutely safe, has no jamming points, is easy to assemble and to operate. Furthermore, the required driving forces can be produced in the best way in that the motor, the drive and the control element can be arranged in the protective tube. In addition, maintenance and constructive advantages are offered by this arrangement. The forces required for raising and lowering the post or the tube are optimally transmitted and by the addition of a spring, kept in an optimally reduced frame of reference. The raising safeguard offers for the barrier post a response to the traffic regulations and quality requirements. The barrier post does not only meet the general regulations, but also saves the vehicle owner the trouble to inspect the vehicle each time after leaving the parking space, because an inadvertent raising or a premature raising of the barrier post is absolutely prevented. Advantageously, such a barrier post can also be passed by low slung vehicles. Based on its construction, such a barrier post is relatively simple due to its already mentioned flat configuration. Besides, such barrier posts can be advantageously erected on available driveways, parking lots or on the floor of parking garages, without additional work.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
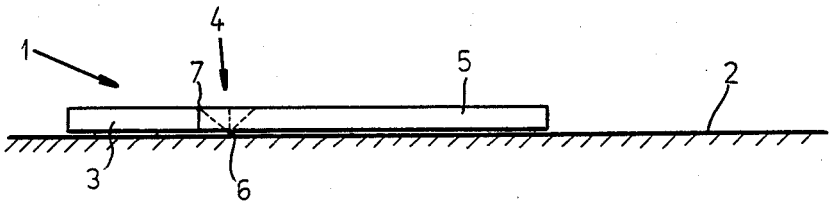
FIG. 1 is an elevational view of a barrier post in folded-down position.

A barrier post in lying position is shown in FIG. 1. This barrier post lies on the driveway , to which its 3 is secured, for instance by holding screws. It is also possible to cast the base 3 into the driveway, to weld it thereto, or to connect it with the driveway 2 in an other way.

The barrier post 1 has in addition to the base 3, a tube 5 connected to the base 3 via a swivel hinge 4. This tube 5 is brought from the horizontal into the vertical position about the swivel joint 4, as can be seen from FIGS. 2 and 3.

Figure 2:
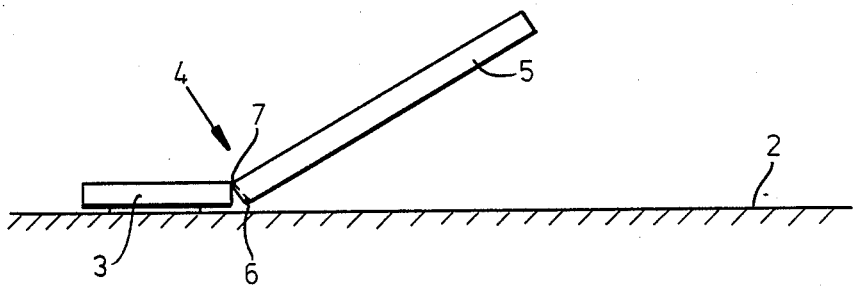
FIG. 2 is an elevational view of a barrier post in a half-raised position.
Figure 3:
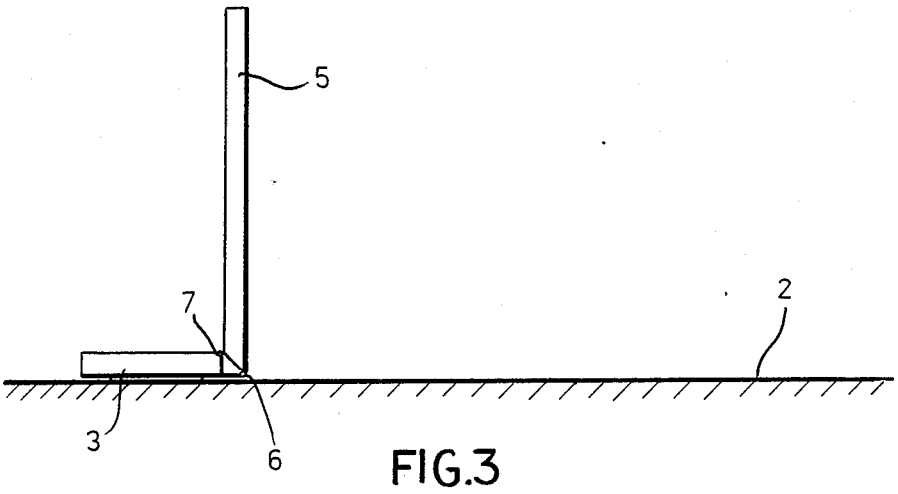
FIG. 3 is an elevational view of a barrier post in upright position.

In the embodiment of FIGS. 1 to 3, this swivel hinge 4 is formed by a lower hinge 6 and an upper hinge 7, whereby the lower hinge 6 is a connection between the base and a motion screw, while the upper hinge 7 effectuates directly the connection between the base 3 and the tube 5.

Figure 4:
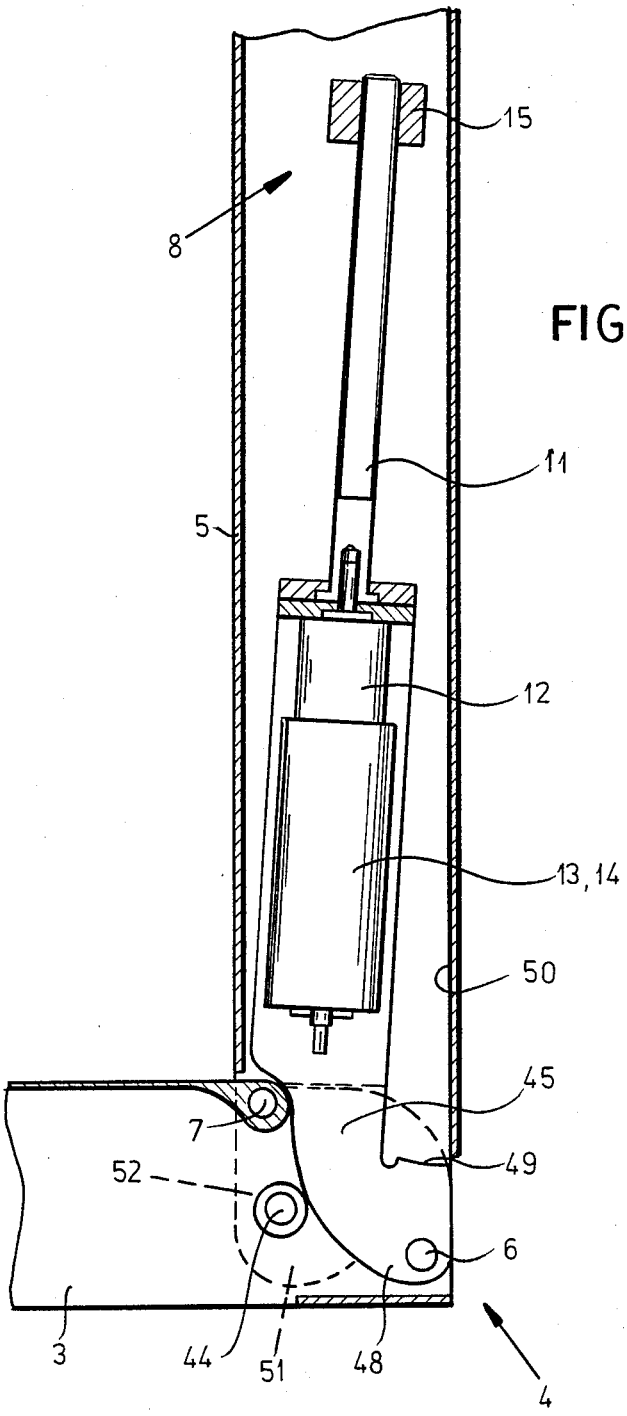
FIG. 4 is a longitudinal section of a barrier post shown in upright position.

FIG. 4 shows the inside of the barrier post 1 in an upright position. It will be clear that the upper hing 7 and lower hinge 6 are arranged at a distance from each other and at the opposite wall or sides of the tube 5. In the middle between them, a cylinder lock 44 is arranged, which secures the tongue 51 (of the tube 5) with the bore 52 (of the base 3) when the cylinder lock 44 is correspondingly engaged.

The raising and lowering of the barrier post 1 is performed via the motion screw 11 which serves as a kind of guide 8, and which on the one hand, is connected to the base (3) and, on the other hand, with the tube (5). The rotation of the motion screw is caused by the motor (13) via the drive (12), whereby a control element (14), here not shown in detail, can switch the motor (13) on and off.

The motion nut (15) has a screwthread corresponding to that which presents a threading corresponding to the of the motion screw (11) is secured on the tube, in the embodiment shown in FIG. 4. When the motion screw (11) is driven, a shortening takes place which forcibly causes the tube (5) to swing about the upper hinge (7) into the horizontal position. When by means of the motor (13) the motion screw is rotated in the opposite direction, the tube (5), respectively the barrier post (1) is raised again.

The motor (13) with the drive (12) and the motion screw (11) are held at their lower end by an end portion (45) which has a pistol-like configuration and is secured via the lower hinge (6) at its pistol handle end. This end portion (45) is correspondingly guided by a holder (46) which is fastened to the tube wall (50) and has a slot (47).

Figure 5:
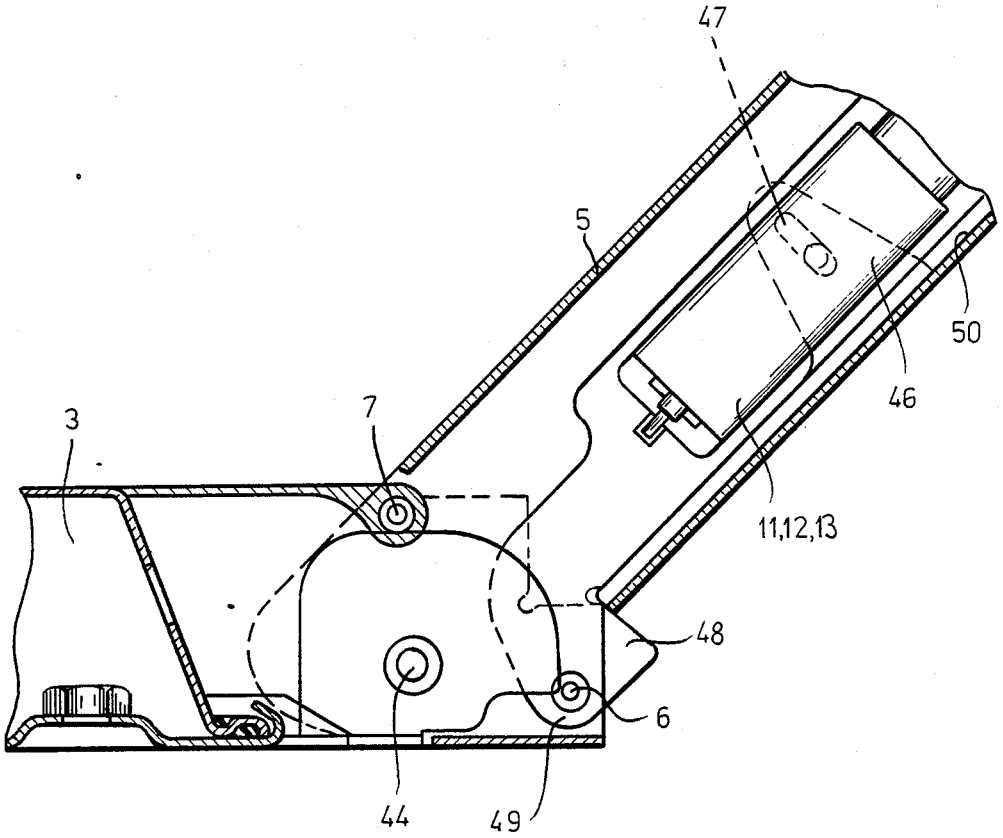
FIG. 5 is a section of the a barrier post according to FIG. 4, in half-raised position.

FIG. 5 shows the arrangement of the holder (46) with the slot (47). While the outer handle end (48) receives the lower hinge (6), the inner handle end (49) is so shaped as to always insure that a permanent seal with respect to the tube wall (50) exists. For this purpose, the handle end (49) has a curved shape, whereby, during the lowering of the barrier post (1) as shown in FIG. 5, this handle end (49) projects outwardly beyond the tube wall (50) for a short time.

Figure 6:
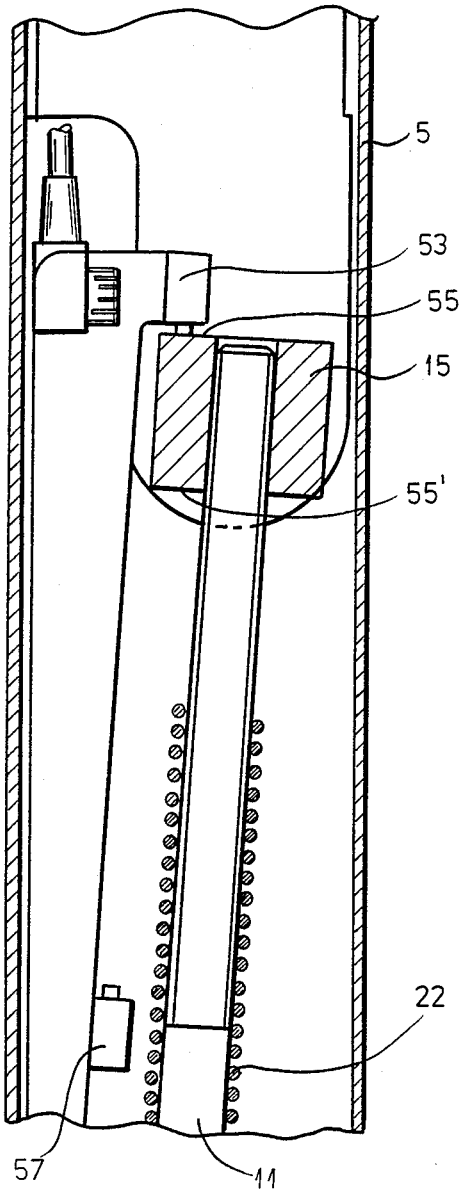
FIG. 6 a partial sectional view of the barrier post according to FIG. 4; in the area of the upper end of the motion screw.

FIG. 6 illustrates the motion control during lowering and raising of the barrier post (1), by means of an upper limit switch (53) and a lower limit switch (54). These limit switches (53, 54) during the movement of the motion screw (11) through the motion nut (15), come to push against the upper edge (55) or the lower edge (55') of the motion nut (15). Also clearly shown is here the arrangement of a spring (22) on the motion screw, which supports the raising operation, as will be explained later.

Figure 7:
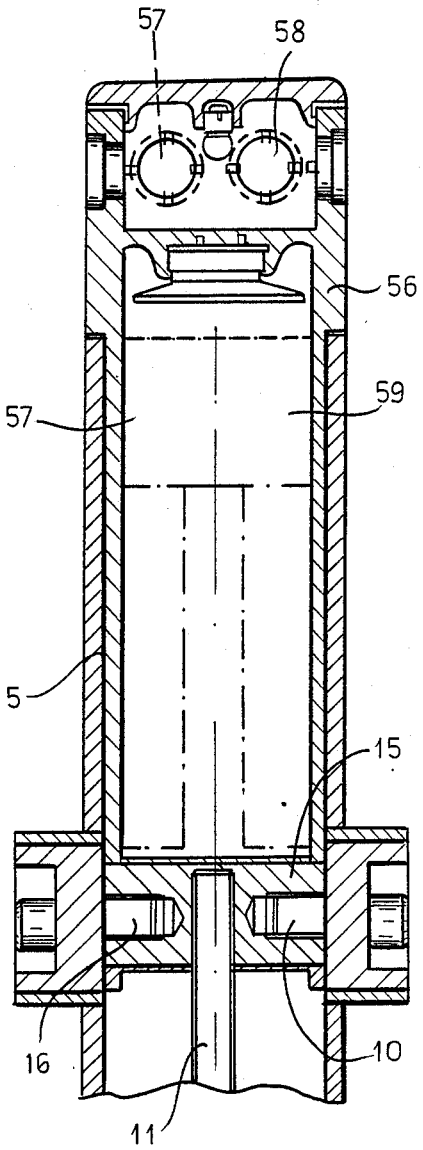
FIG. 7 is a view of the head of the barrier post, in section.

FIG. 7 shows a section of the head (56) of the barrier post (1). A the motion nut (15), a receiver (57) for the individual control transmitters, and a timer (59) are arranged, and thereabove a safety device 58 against raising is mounted. It is also conceivable to locate the receiver (57) in the end portion of the head (56), or to combine it with the safety device 58 against unintentional raising. This safety device 58 against raising will be explained in detail later. FIG. 7 also shows the pivot 10 connecting the nut to the head 56 of the tube 5.

The embodiment which can be seen in FIGS. 8 to 11 differs from the one described above in that the motion screw (11) is here fastened to the head while the motion nut (15) effectuates the raising and lowering, due to a corresponding guide (8). To the guide (8) the sliding guide (9) is again movably connected, wherefor here too an upper hinge is used, which can be seen especially from FIG. 10.

Figures 10, 11:
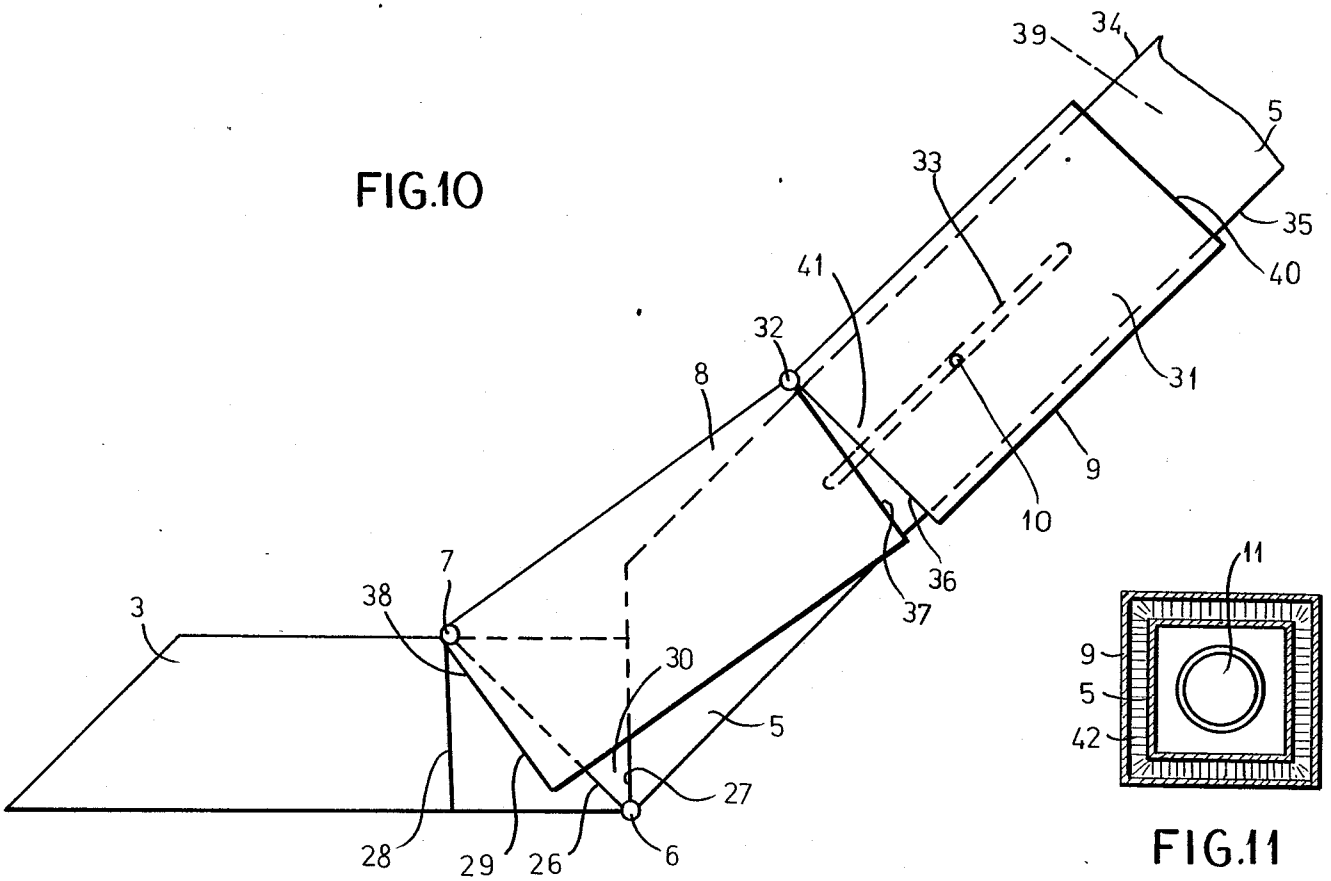
FIG. 10 shows the barrier post of FIG. 8 in a lateral elevational view, in the half-raised position.
FIG. 11 is a cross section through the barrier post.

The drive is lodged inside the tube (5). This drive is connected via the pin (10) with the sliding guide (9) and thereby also with the guide (8), so that at an upward movement of the pin (10), the sliding guide (9) is concurrently lifted, and together therewith in the end also the entire tube (5). Details will be referred to below. FIG. 10 shows how the sliding guide (9) and the pivotal guide (8) swing in order to entrain the tube (5) and to finally bring it into vertical position.

Inside the tube (5) the already mentioned screw (11) is mounted. This motion screw (11) is set into rotation via the drive (12) and the motor (13) and thereby entrains the motion nut (15) either upwardly or downwardly. The travel of the motion nut (15) depends on the rotation direction of the motion screw (11). The direction of rotation is established by the control element (14), whereby this control element (14) is equipped with remote-control means, so that a remote-control of the barrier post (1) becomes possible with simple means.

As already mentioned, the motion nut (15). is provided on both sides with pins (10, 16) which bring about the connection with the sliding guide (9).

The pins (10, 16) are releasably mounted to the motion nut (15), especially via the threading (17, 18) and screwed in such a manner that when the polyhedron (19) is engaged, each of the two pins (10, 16) can separately be removed. After the pins (10, 16) have been unscrewed, the barrier post (1) can be activated manually. Through the shifting of the tube (5), the guide (8) and the sliding guide (9) are displaced at the same time, until the tube reaches either the vertical or the horizontal position.

In order to insure an unobjectionable drive of the motion screw (11), the screw is mounted at its lower end in a bearing (20), which is fixed via holding shells (21), or supported on the respective base, and in addition thereto also a spring, (22) is supported. The spring characteristic or its spring force is so calculated that the raising torque is almost compensated. The drive is relieved by this spring (22) each time during raising of the tube and the operation of the barrier post (1) is thereby considerably facilitated.

Figure 8:
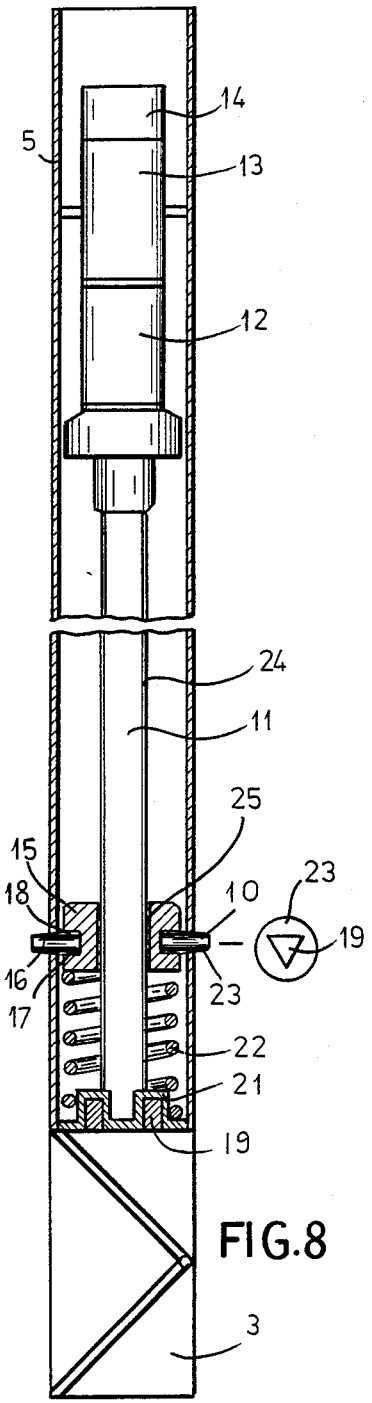
FIG. 8 is a section through a folded-down barrier post, with the motion screw positioned at its head.

The free ends (23) of the pins (10, 16) are equipped with trihedron sockets (19), as clearly shown in FIG. 8. In this in the small drawing next to FIG. 8. This way, it is possible to operate the barrier post (1) manually, which for instance can become necessary to give access to firefighters.

It is self-understood that the motion screw (11) is provided with an external thread (24) and the motion nut (15) with a corresponding internal threading (25). As a result, it is possible to raise or lower the motion nut (15) corresponding to the direction of rotation imparted to the motion screw (11), whereby it concurrently entrains the tube (5), as already mentioned.

Figure 9:
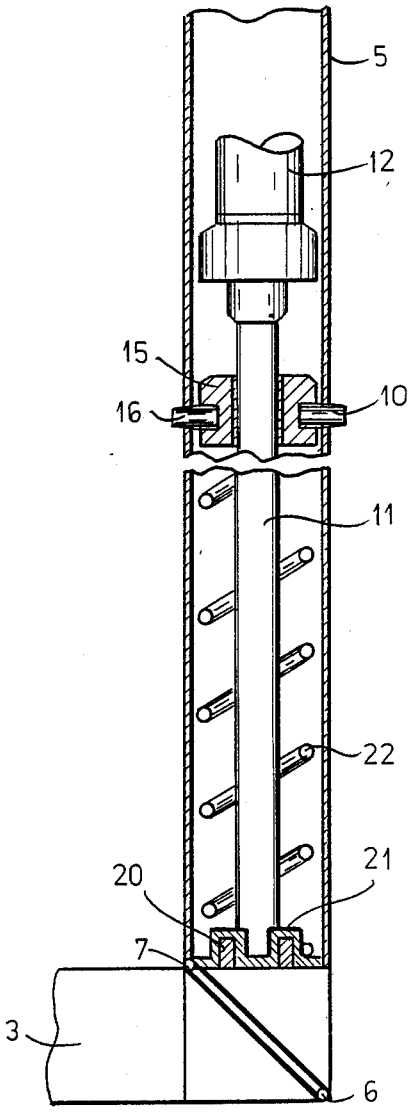
FIG. 9 is a section through the barrier post according to FIG. 8, in upright position.

FIG. 9 shows the spring (22) in relaxed position. Here, the barrier post (1) is in the position shown in FIG. 3. When the barrier post or the tube (5) is lowered, the spring (22) is again compressed by the motion nut (15), until it assumes the position which can be seen in FIG. 8.

In order to clarify the special configuration of the guide (8) and the sliding guide (9), in FIG. 10 the position shown in FIG. 2 is again illustrated at a larger scale. Jamming points are avoided here, due to the fact that on the base (3) and on the tube (5), corresponding inclines 26, 27 are provided: whereby the incline (26) also has in addition a rear wall (30) which insures that there really are no possibilities to create jamming points. Also the partition (28, 29) on the base (3) and on the guide (8) insure that such jamming points do not occur. The inclines (26,27), i.e. all contact edges (36, 37, 38) which are so bevelled that even when they have to be held with the fingers or there is manual intervention, the fingers can not be caught therein.

The sliding guide (9) is formed as a stable hollow tube, in order to allow a smooth sliding along the tube (5) and to achieve a secure guiding, and thereby trasmission of forces from the motion nut (15) to the sliding guide (9) and thereby to the barrier post (1). This holloow tube (31) or the sliding guide (9) is, as already mentioned, articulatedly connected to the guide (8) by the joint (32), so that a parallel sliding motion of the walls of the hollow tube (31) with respect to the walls of the tube (5) and the tube edges (34, 35) is insured. The numeral (33) indicates the slot whose edges run parallel with the tube edges (34, 35).

It has already been mentioned that all contact edges (36, 37, 38) are so bevelled, namely in the direction of the inner space (39), that even at the touch no jamming occurs.

The upper margin (40) and the lower margin (41) of the sliding guide (9) are suitably provided with a gasket (42) to prevent the penetration of water and dirt. This is shown in FIG. 11.

Figure 12:
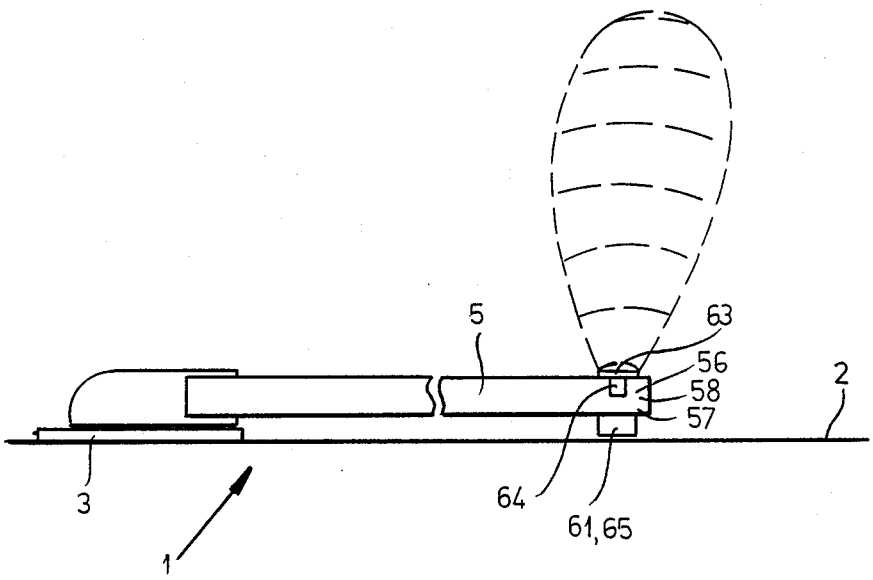
FIG. 12 is an elevational view of a folded-down post with safeguard against raising.

In FIG. 12, a folded-down barrier post (1), remote-controlled from an approaching vehicle, is shown. In the barrier post (1) in the area of the head (56) an additional receiver (57) and a safety device 58 against raising are arranged, which works according to the so-called Doppler-effect. A field which is disturbed when the vehicle passes over it can also be created by means of a radar-survey field, also an ultrasound field or with the aid of a corresponding opto-electronic device, which disturbance is registered by the receiving device and serves for turning off or blocking the receiver (57). In this way, the receiver (57) cannot be activated and turn on the motor (13) as long as the vehicle is over the barrier post (1). When the vehicle leaves its parking spot, the survey field comes bask to normal, the receiver (57) is no longer blocked so that then the transmitter assigned to the sender can activate the motor (13) and the post can again be brought into its vertical position. The antenna (63) with the thereto connected amplifier

(64) can be itself made activatable or disconnected, by assigning a sensor (61) to the head (56) of the barrier post (1), which fine-tunes the antenna (37) only when the barrier post (1) is already folded down. This feeler (61) is suitably built to be at the same time a support element (65), which offers support to the barrier post (1) as such on the driveway (2).

Figure 13:
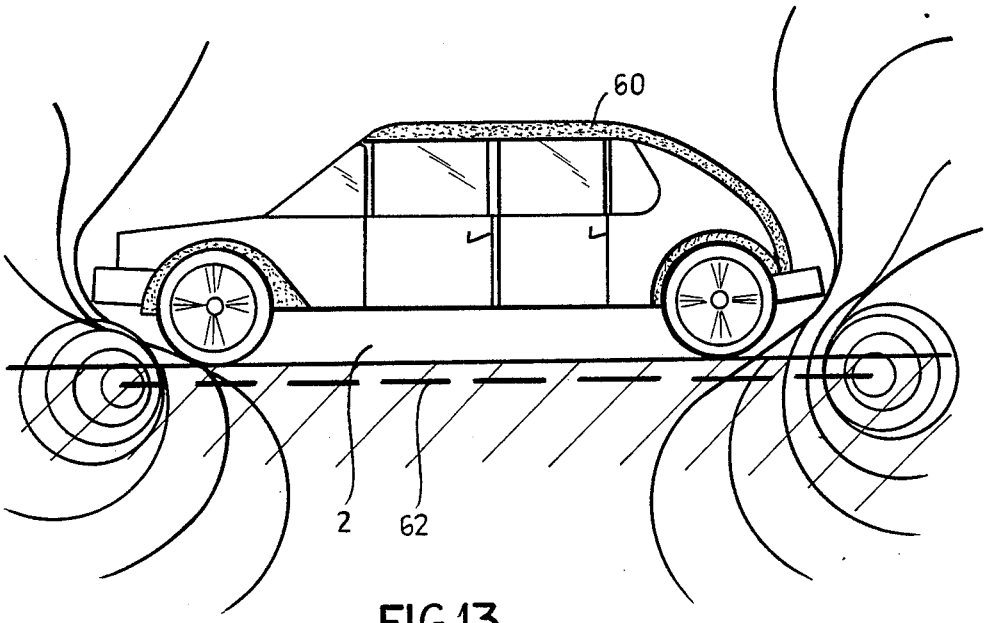
FIG. 13 is a schematic representation of a safeguard against raising, with a cable loop integrated in the driveway.

According to FIG. 13, an induction loop is provided underground, which, when the vehicle passes over it, blocks the receiver, so that it can not be switched on. When the parking place or the corresponding driveway (2) is vacated, the induction loop, resp. the cable loop is passed over for a second time, whereby the receiver (57) is switched on or activated. The arrangement of such a damped cable loop (62) on which the vehicle (60) stands, is correspondingly indicated in FIG. 13.

Further possibilities for a safety device against raising (58) are to be found in an electronic controls with step-by-step function, which at every new impulse causes the direction of the motion to be reversed. It is also possible to build into the post a metal detector, which switches the receiver, when the barrier post is completely or partially covered by the vehicle (60). Finally, the sender can be provided with a on-and off switch, in order to force the user to a conscious activation. The same goes for a multiple activation of the emitter, which for instance provides that within a certain time, a signal is to be emitted several times, i.e. two or three times, until it leads to a certain switching process. Finally the sender per se can be locked or blocked by the use of a thereto-assigned personal chip, which can be removed when leaving the vehicle and reinserted when the driver returns to the vehicle. Finally, the parking place can be provided with a switch which is activated by the weight of the vehicle, and which switches the receiver off, and then later, when leaving the parking place, switches it on again. Finally, it can be arranged that the sender should emit, besides a radio signal, also a polarized light beam, so that the radio signal becomes only then a switching signals, when at the same time the control device can also receive the polarized light. Finally, safety labels can be used, similar to the ones used in retail stores against shoplifting. These labels are fastened under the bumper of the vehicle (60) and are recognized by the receiver (57) in the base of the post. At the movement of recognition, the receiver is also switched off, whereby these labels have a metal strip made of a special alloy, so that corresponding activation can be reserved for each corresponding vehicle. Particularly advantageous is a switching system wherein the receiver (57) has to be fine-tuned by the emitter every time. Hereby, at least an unintentional raising of the post (1) underneath the vehicle (60) is prevented.

Figure 14:
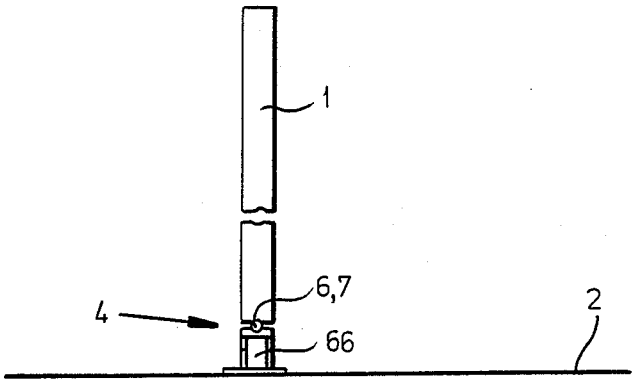
FIG. 14 shows a barrier post with double hinge in a lateral elevational view.
Figure 15:
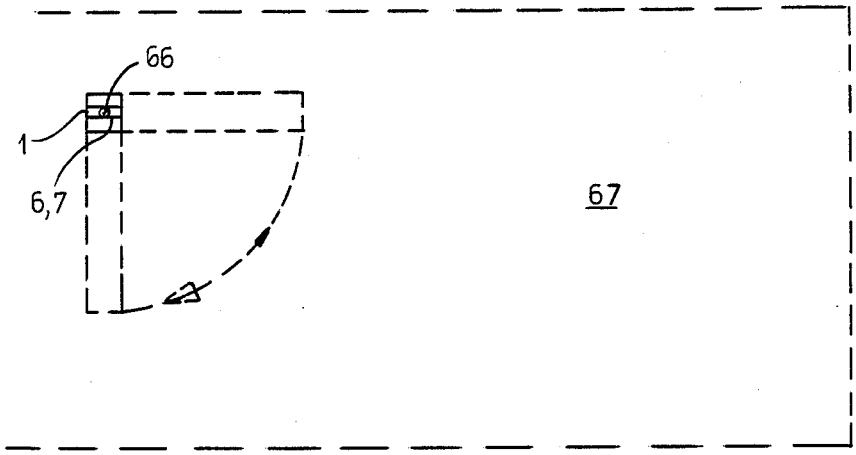
FIG. 15 shows the barrier post of FIG. 14 in a top view.

FIGS. 14 and 15 are meant to clarify a further safety device, which at the same time acts as a safety device against theft. For this purpose, the barrier post (1) is equipped, in addition to the swivel joint (4) which is built as a horizontal hinge, with a second vertically arranged articulation (66). The horizontally lying hinge is thereby, as shown in FIG. 15, arranged in the travel direction of the vehicle not shown in this figure, while the second articulation (44) is disposed vertically, as shown.

Prior to the entering of the driveway (2), respectively the parking space (67), the barrier post (1) is in the position shown in FIG. 14. When the respective vehicle (60) reaches the parking space, the drive in the barrier post (1) is activated through the remote control, i.e. through the here not shown emitter, so that the post (1) is swung about the swivel hinge (4) respectively the corresponding drive shaft, and folded down in the direction of the driveway. When the barrier post (1) has reached this postion, the drive is stopped, and the swivel drive assigned to the articulation (66), respectively to the corresponding drive shaft becomes effective, in order to swing the barrier post (1) from its transversal direction as per FIG. 15 into the longitudinal direction. Then, the vehicle (60) can assume its place on the parking space (67), whereafter the barrier post (1) is swung back from its longitudinal direction into the transversal direction, namely over the swivel drive which when it reaches the final position switches on the drive assigned to the swivel hinge (4), respectively to the corresponding shaft, so that the barrier post (1) swings back again into the vertical position. The barrier post (1) is thereby slightly offset with respect to the middle, as can be seen from FIG. 15, so that in an emergency, it can be passed also in its transversal direction. This way, it is particularly insured that the horizontally lying barrier post (1) always has the required freedom of movement during swinging under the vehicle (60). For defining the parking space, stones or the like can be provided laterally, so that a cross-parking is effectively prevented.

I claim:

1. A barrier post adapted to control access of a vehicle to a protected zone, comprising:
- a base anchored to the ground at said zone;
- a tube mounted on said base and swingable between an upright position and a recumbent position;
- swivel hinge means for enabling swinging of said tube between said positions, said swivel hinge means including a lower hinge and an upper hinge respectively at lower and upper levels and horizontally offset from one another, one of said hinges connecting one end of said tube to said base;
- a motor and motor-driven drive received in said tube;
- means propelled by said motor and said motor-driven drive and received in said tube for displacing said tube between said positions at said swivel hing emenas, said means propelled be said motor and said motor-driven drive including:
  - a screw member extending within said tube and retained against linear movement parallel to the screw member in said tube and driven by said drive,
  - a nut member threaded onto said screw member and displaceable linearly upon rotation of said screw member by said drive, and
  - means for conencting one of said members swingably with said tube; and
- means for connecting the other of said members to the other of said hinges whereby rotation of said screw member displaces said tube about both said hinges of said swivel hinge means.

2. The barrier post defined in claim 1 wherein said screw member is connected to said lower hinge by a pistol-handle shaped end portion and said nut member is secured to said tube at an opposite end thereof.

3. The barrier post defined in claim 2 wherein said lower hinge is pivotably connected to an outer handle end of said pistol handle portion and a wall of said tube reaches to an inner handle end of said pistol handle portion.

4. The barrier post defined in claim 1 wherein said upper hinge is located at an inner side of said tube and said lower hinge at an outer side of said tube with respect to a direction of pivoting between said positions.

5. The barrier post defined in claim 1 wherein said motor and said motor-driven drive are mounted together with said screw member in a holder formed with a slot provided on an inner inside wall of said tube and transversely movable between said lower hinge and said nut member.

6. The barrier post defined in claim 1 wherein said tube has a tongue reaching into a region of said base and said base and said tongue are provided with aligned bores between said hinges engaged by the cylinder of a lock.

7. The barrier post defined in claim 1 wherein said screw member is secured in a part of said tube remote from said one end of said tube and said means for connecting the other of said members to the other of said hinges includes a sliding guide slidably on said tube and connected to said nut member for displacement therewith, and a further guide articulated to said sliding guide and connected to said upper hinge.

8. The barrier post defined in claim 7 wherein said sliding guide is a hollow tubular element surrounding said tube and said guides are connected by an articulation and said sliding guide is connected to said nut member by removable pins.

9. The barrier post defined in claim 7 wherein said pins are guided in slots formed in said tube parallel to handle edges of said tube.

10. The barrier post defined in claim 1 wherein said screw member is supported in a bearing above said swivel hinge means and between said bearing and said nut member, a spring is provided bracing said nut member away from said swivel hinge means.

11. The barrier post defined in claim 10 wherein said spring has a spring force approximately compensating the force required for raising said tube from said recumbent position to said upright position.

12. The barrier post defined in claim 1, further comprising a receiver at the other end of said tube controlling said motor and blockable when a vehicle is in said zone to prevent raising of said tube from said recumbent position to said upright position.

13. The barrier post defined in claim 12 wherein said receiver includes a microwave emitter and pickup operating by the Doppler-effect and connected to block said receiver when a Doppler-effect occurs.

14. The barrier post defined in claim 13 wherein said emitter and pickup are switchable by a sensor activated by impact in a region of said zone.

15. The barrier post defined in claim 12 wherein an emitter for a label system adapted to be carried by the vehicle is provided to block said receiver upon the detection of a label corresponding to said emitter and affixed to said vehicle.

16. The barrier post defined in claim 1, further comprising a pressure switch in the region of said zone responsive to the presence of said vehicle for blocking said receiver.

17. The barrier post defined in claim 1, further comprising an induction loop imbedded in the region of said zone and responsive to said vehicle for blocking said receiver.

18. The barrier post defined in claim 1; further comprising an articulation between said base and said tube in addition to said swivel hinge means and pivotally connecting said tube to said base for pivotal movement about a vertical axis and provided with a pivoting drive in addition to said motor.

19. The barrier post defined in claim 18 wherein said hinges are horizontal hinges and said motor and pivoting drive are connected to be alternately operable.

20. The barrier post defined in claim 1, further comprising a signal emitter connected with sensors on said base disposed laterally with respect to said tube and with said motor.

* * * * *